US010267331B2

(12) United States Patent
Li et al.

(10) Patent No.: US 10,267,331 B2
(45) Date of Patent: Apr. 23, 2019

(54) LIQUID PUMP HOUSING

(71) Applicant: JOHNSON ELECTRIC INTERNATIONAL AG, Murten (CH)

(72) Inventors: Min Li, Shenzhen (CN); Zhi Ping Fu, Shen Zhen (CN); Moola Mallikarjuna Reddy, Shen Zhen (CN); Kok Ang Chong, Hong Kong (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 170 days.

(21) Appl. No.: 15/251,274

(22) Filed: Aug. 30, 2016

(65) Prior Publication Data

US 2017/0058913 A1 Mar. 2, 2017

(30) Foreign Application Priority Data

Aug. 31, 2015 (CN) ..... 2015 1 0549648

(51) Int. Cl.

| | |
|---|---|
| ***F04D 29/42*** | (2006.01) |
| ***F04D 1/00*** | (2006.01) |
| ***F04D 13/06*** | (2006.01) |
| ***F04D 15/00*** | (2006.01) |
| ***F04D 29/40*** | (2006.01) |

(52) U.S. Cl.

CPC ..... *F04D 29/406* (2013.01); *F04D 1/00* (2013.01); *F04D 13/06* (2013.01); *F04D 13/0606* (2013.01); *F04D 15/0077* (2013.01); *F04D 29/426* (2013.01)

(58) Field of Classification Search

CPC ..... F04D 29/106; F04D 13/0693; F04D 13/0606; F04D 15/0077; F04D 13/025; F04D 13/0613; F04D 13/0626; F04D 29/42

See application file for complete search history.

(56) References Cited

U.S. PATENT DOCUMENTS

| | | | | |
|---|---|---|---|---|
| 3,758,236 A | | 9/1973 | Zimmerman | |
| 4,720,648 A | * | 1/1988 | DeVries | H02K 5/10 29/428 |
| 4,904,166 A | * | 2/1990 | Wasemann | D06F 39/085 417/360 |
| 7,034,416 B2 | * | 4/2006 | Simofi-Ilyes | H02K 5/20 310/58 |

(Continued)

FOREIGN PATENT DOCUMENTS

| | | | | |
|---|---|---|---|---|
| DE | 1950500 U | | 11/1966 | |
| DE | 38 02 890 | * | 8/1989 | F04D 29/60 |

(Continued)

*Primary Examiner* — Bryan Lettman
*Assistant Examiner* — Timothy P Solak
(74) *Attorney, Agent, or Firm* — Muncy, Geissler, Olds & Lowe, P.C.

(57) ABSTRACT

A liquid pump includes a housing, a motor fixed in the housing, and an impeller driven by the motor. The motor includes a stator and a rotor rotatable relative to the stator. The impeller is connected to a rotor of the motor. The housing includes a guide wall surrounding the stator, and a guide face extending outwardly from an outer surface of the guide wall to guide a liquid flowing to the guide wall to flow in a direction away from the stator, thus ensuring the electrical safety of the liquid pump.

11 Claims, 4 Drawing Sheets

(56) References Cited

U.S. PATENT DOCUMENTS

| | | | | |
|---|---|---|---|---|
| 7,960,881 | B2 * | 6/2011 | Burton | H02K 5/10 310/157 |
| 8,283,824 | B2 * | 10/2012 | Vadillo | H02K 5/10 310/407 |
| 2013/0011254 | A1 * | 1/2013 | Avedon | F04D 25/08 415/221 |

FOREIGN PATENT DOCUMENTS

| | | | |
|---|---|---|---|
| DE | 3802890 | A1 | 8/1989 |
| EP | 0610826 | A2 | 8/1994 |
| JP | 2014030464 | A | 2/2014 |

* cited by examiner

LIQUID PUMP HOUSING

CROSS REFERENCE TO RELATED APPLICATIONS

This non-provisional patent application claims priority under 35 U.S.C. § 119(a) from Patent Application No. 201510549648.9 filed in The People's Republic of China on 31 Aug. 2015.

FIELD OF THE INVENTION

The present disclosure relates to liquid pumps.

BACKGROUND OF THE INVENTION

A liquid pump has an impeller and a motor driving the impeller. In home appliances such as washing machines or dish washers, liquid pumps are used to pressurize and deliver water so as to introduce clean water into the appliances for cleaning the clothes or dishes in the appliances, and finally discharge the wash water out of the appliances. In a conventional existing liquid pump, when the liquid flows, especially when discharged out, the liquid probably flows to the area of windings of the motor along a housing of the liquid pump, causing short-circuit of the windings. Therefore, the existing liquid pump structure has potential electrical safety hazard.

SUMMARY OF THE INVENTION

Thus, there is a desire for a liquid pump which can effectively isolate the stator and ensures the electrical safety.

A liquid pump includes a housing, a motor fixed in the housing, and an impeller for being driven by the motor. The motor includes a stator and a rotor rotatable relative to the stator. The impeller is coupled to the rotor of the motor. The housing includes a guide wall surrounding the stator, and a guide face extending outwardly from an outer surface of the guide wall to guide a liquid flowing to the guide wall to flow in a direction away from the stator.

Preferably, the guide wall is C-shaped. A middle of the guide wall extends downwardly in a tangential direction to form the guide face. A bottom end of the guide face is spaced apart from a lower portion of the guide wall. The liquid flows downwardly along an upper portion of the guide wall and continuingly flows to be discharged to an outside along the guide face.

In comparison with the prior art, the housing of the single phase liquid pump of the present disclosure includes the guide wall. The guide wall includes the guide face extending downwardly. The water flows downwardly under the guide of the guide face, which is spaced apart from the lower portion of the guide wall and is discharged to the outside away from the stator, thus ensuring the electrical safety of the liquid pump.

DETAILED DESCRIPTION OF THE PREFERRED EMBODIMENTS

Figure 1:
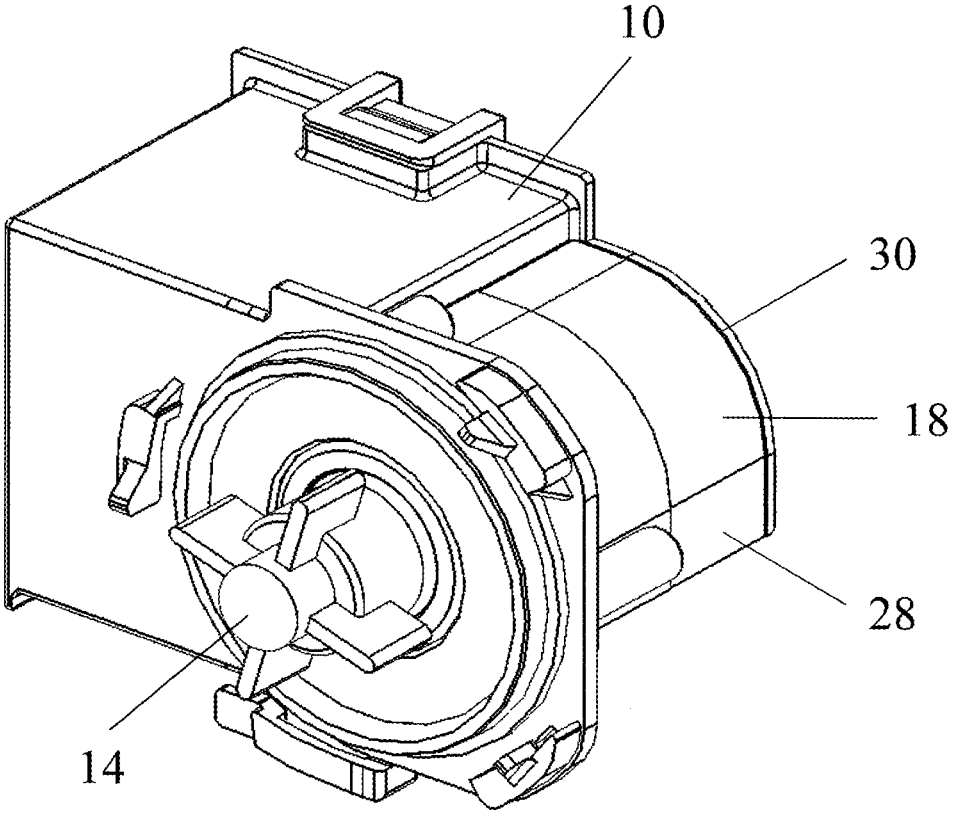
FIG. 1 illustrates a liquid pump according to one embodiment of the present disclosure.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

Figure 2:
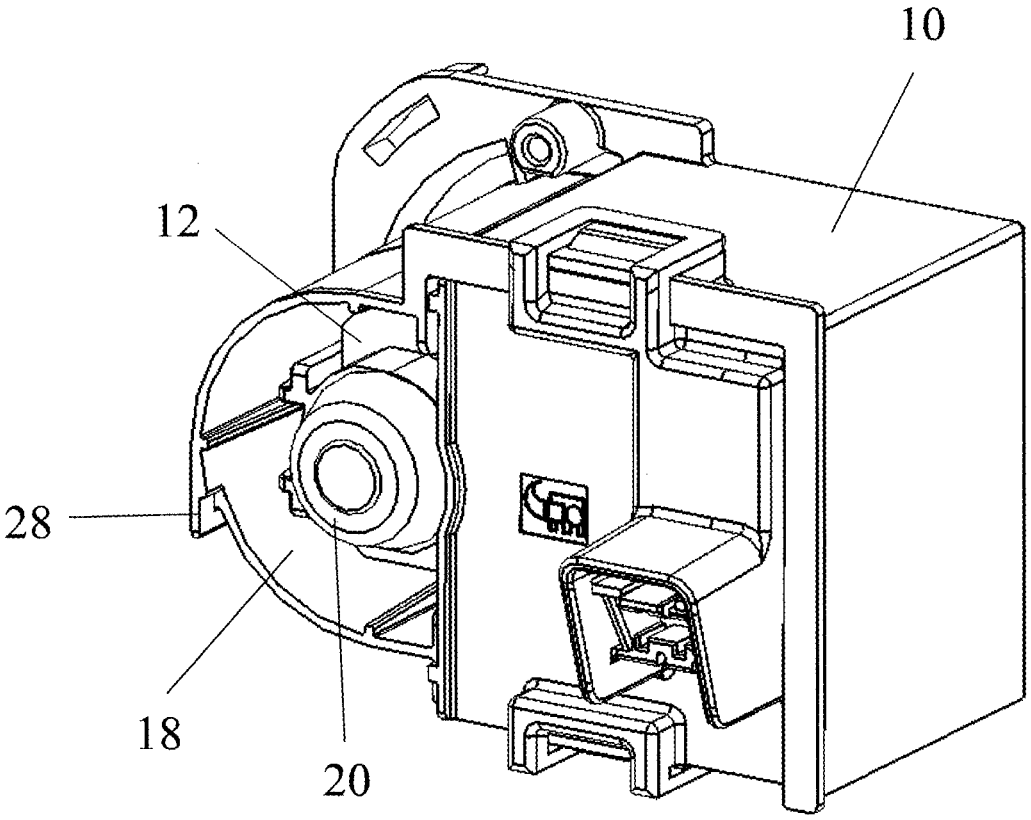
FIG. 2 illustrates the liquid pump of FIG. 1, viewed from another aspect.

Referring to FIG. 1 to FIG. 2, a liquid pump in accordance with one embodiment of the present disclosure includes a housing 10, a motor 12 fixed in the housing 10, and an impeller 14 driven by the motor 12. The motor 12 is preferably a single phase permanent magnet motor which includes a stator and a rotor rotatable relative to the stator. Preferably, the stator is formed by a U-shaped magnetic core with windings wound therearound. The magnetic core forms a pair of magnetic poles 16. The magnetic poles 16 define a space for receiving the rotor. The rotor is rotatably disposed in the space between the magnetic poles 16 of the stator and is preferably a permanent magnet rotor including a pair of permanent magnets. When the motor 10 is powered on, the windings are energized causing the magnetic poles 16 of the stator to be polarized, and the magnetic field of the stator interacts with the magnetic field of the permanent magnets of the rotor to drive the rotor to continuously rotate. The impeller 14 is coupled to the rotor for synchronous rotation therewith.

The housing 10 isolates the stator from the rotor and impeller 14, preventing water from entering the stator to cause short-circuit of the windings. The housing 10 includes a guide wall 18 for guiding water to be discharged out, and a sleeve 20 formed between the stator and the rotor. The sleeve 20 is a cylindrical structure in which the rotor is received. The sleeve 20 and the guide wall 18 define therebetween a space for receiving the stator. In this embodiment, the magnetic poles 16 of the stator are fixedly attached around the sleeve 20. An outer wall surface of the sleeve 20 is formed with a positioning portion 22 for positioning and mounting the stator.

Preferably, there are two positioning portions 22 extending along an axial direction of the sleeve 20. Each positioning portion 22 engages with one magnetic pole 16 of the stator and includes a first rib 24 and a second rib 26 perpendicular to the first rib 24. The two first ribs 24 are spacingly disposed in parallel with each other. A distance between outer wall surfaces of the two first ribs 24 is substantially equal to a spacing between the two magnetic poles 16. The two second ribs 26 are coplanar. Each second rib 26 extends perpendicularly from the outer wall surface of one corresponding first rib 24 in a direction away from the other first rib 24. Preferably, a connecting area between the second rib 26 and the first rib 24 is offset from a connecting area between the first rib 24 and the sleeve 20 by a distance. The positioning portion 22 has an overall cross-section in the form of the letter "T". A small space is formed between the first rib 24, the second rib 26 of each positioning portion 22 and the outer wall surface of the sleeve 20

In assembly, the two magnetic poles 16 of the stator are placed at outer sides of the two positioning portion 22 and are attached around the outer wall surface of the sleeve 20 along the axial direction. The axially-extending positioning portion 22 can guide the relative movement between the magnetic poles 16 and the sleeve 20 for quick assembly. After assembled, distal ends of the two magnetic poles 16 are locked in the small spaces between the two positioning portions 22 and the outer wall surface of the sleeve 20, respectively. The first rib 24 limits the position of the magnetic pole 16 in a tangential direction, and the second rib 26 limits the position of the magnetic pole 16 in the radial direction, such that rotation or wobble of the magnetic poles 16 of the stator after assembled is prevented. This ensures coaxiality between the stator and the rotor, maintains smooth operation of the motor 12, and reduces noise.

Figure 3:
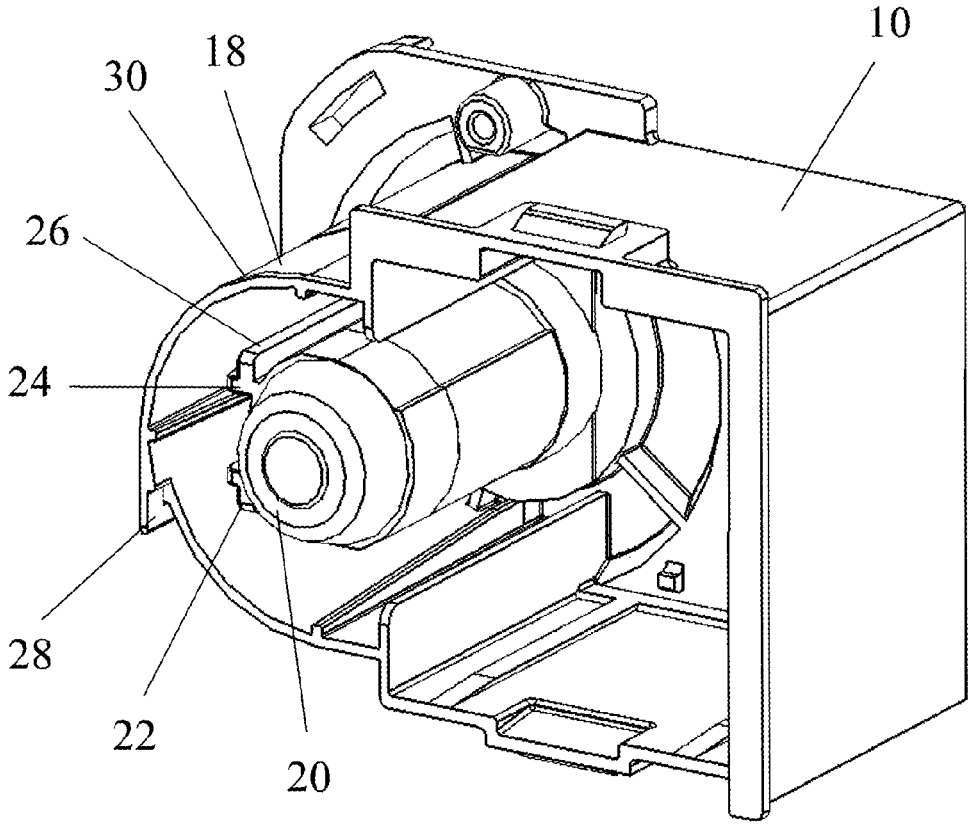
FIG. 3 illustrates a housing of the liquid pump of FIG. 2.
Figure 4:
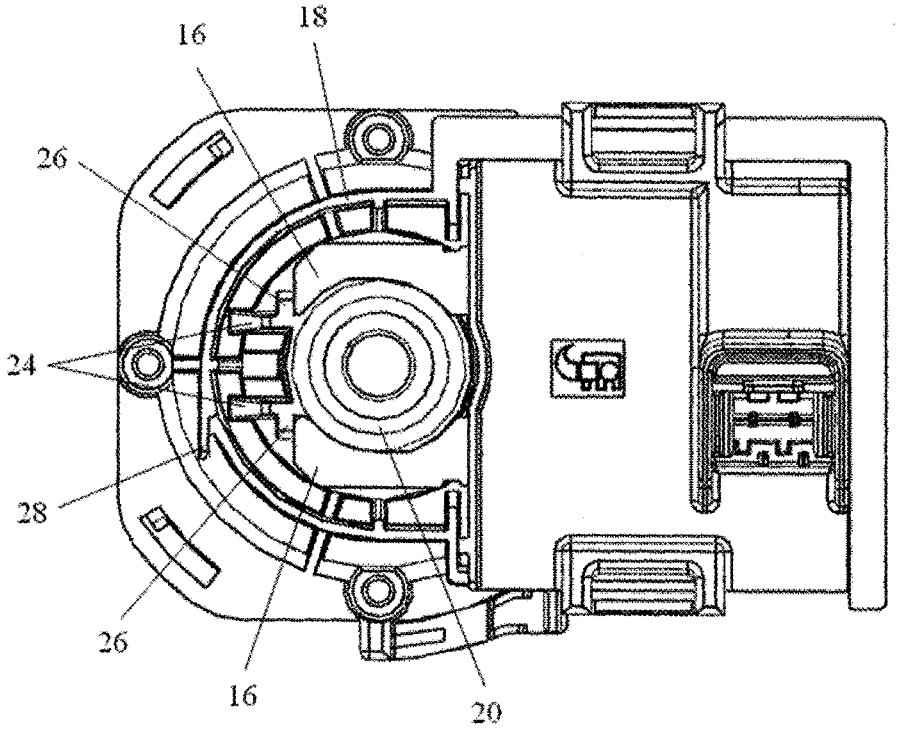
FIG. 4 is a front view of the liquid pump of FIG. 2.

Referring to FIG. 3 and FIG. 4, the guide wall 18 surrounds the stator and has a generally C-shaped arcuate structure. A middle of the guide wall 18 extends downwardly in a tangential direction to form a guide face 28. The guide face 28 is preferably a vertical plane. Preferably, in use, the motor 12 is usually horizontally disposed with its central axis extending horizontally and the middle of the guide wall 18 is at substantially the same level as a central axis of shaft of the motor 12. The guide face 28 extends a width downwardly from a middle of an arcuate surface such that a bottom end of the guide face 28 is lower than the central axis of shaft of the motor 12. Because the guide face 28 extends in the tangential direction, the bottom end of the guide face 28 is spaced apart from a lower portion of the guide wall 18.

When the wash water is discharged out, the wash water flows downwardly along an upper portion of the arcuate guide wall 18. When flowing to the guide face 28, the wash water flows out quickly downwardly along the guide face 28 under the gravity and centrifugal force. Because the bottom end of the guide face 28 is spaced apart from the lower portion of the guide wall 18, the water will not flow to the lower portion of the guide wall 18. Rather, the water flows along the guide face 28 away from the stator and is finally discharged to an outside, thus ensuring the electrical safety of the stator. It should be understood that the guide face 28 may have a deflection angle with respect to the vertical direction, as long as the bottom end of the guide face is spaced a distance from the lower portion of the guide wall 18. Preferably, the guide face 28 deflects toward a side away from the stator, which guides the water away from the stator. Alternatively, the guide face 28 may be an inwardly-concaved arc surface, which cooperates with the upper portion of the guide wall 18 to form an S-shaped structure to guide the water away from the stator.

Preferably, the guide wall 18 forms a flange 30 at an edge thereof. The flange 30 may be perpendicular to the guide wall 18 and extends vertically upwardly a height above the guide wall 18, which blocks the water in the horizontal direction. When the water flows downwardly along the guide wall 18, the flange 30 prevents a portion of the water from flowing horizontally to splash into the space within the guide wall 18 which would affect the electrical safety of the stator. In this embodiment, the flange 30 extends to the bottom end of the guide face 28 to ensure that the water flows downwardly along the guide wall 18 and is discharged to the outside under the guide of the guide face 28. The water flow is away from the stator thus ensuring the electrical safety of the liquid pump.

Although the invention is described with reference to one or more preferred embodiments, it should be appreciated by those skilled in the art that various modifications are possible. Therefore, the scope of the invention is to be determined by reference to the claims that follow.

The invention claimed is:

1. A liquid pump comprising:

a housing, a motor fixed in the housing, the motor comprising a stator and a rotor rotatable relative to the stator; and an impeller coupled to the rotor of the motor;

wherein the housing includes a C-shaped guide wall surrounding the stator, a guide face extending outwardly and downwardly from a portion of an outer surface of the guide wall between two opposite ends of the guide wall to guide a liquid flowing to the guide wall to flow in a direction away from the stator, and wherein a bottom end of the guide face is spaced apart from a lower one of the two opposite ends of the guide wall.

2. The liquid pump of claim 1, wherein the guide face is a vertical plane.

3. The liquid pump of claim 1, wherein the guide face is a plane which deflects at an angle with respect to a vertical plane toward a side away from the stator.

4. The liquid pump of claim 1, wherein the portion of the outer surface of the guide wall from which the guide face extends is lower than one of the opposite ends of the guide wall and higher than the other one of the opposite ends of the guide wall.

5. The liquid pump of claim 4, wherein a middle of the guide wall extends downwardly in a tangential direction to form the guide face, the liquid flows downwardly along an upper portion of the guide wall and continuingly flows to be discharged to an outside along the guide face.

6. The liquid pump of claim 1, wherein the motor is horizontally disposed, a middle of the guide wall is at the same horizontal plane as a central axis of a shaft of the motor, and a bottom end of the guide face is lower than the central axis of the motor.

7. The liquid pump of claim 1, wherein a flange extends vertically upwardly from an edge of the guide wall, and the flange extends to a bottom end of the guide face for blocking horizontal flow of the liquid.

8. The liquid pump of claim 1, wherein the stator comprises a U-shaped magnetic core and windings wound around the magnetic core, the magnetic core forms a pair of magnetic poles, the rotor is a permanent magnet rotor and is rotatably disposed in a space between the magnetic poles of the stator.

9. The liquid pump of claim 1, wherein the housing further includes a cylindrical sleeve, the rotor is received in the sleeve, the magnetic poles of the stator are attached around the sleeve, and the sleeve isolates the stator from the rotor and the impeller.

10. The liquid pump of claim 9, wherein an outer wall surface of the sleeve is formed with two positioning portions which abut against the two magnetic poles of the stator, respectively.

11. The liquid pump of claim 10, wherein each positioning portion comprises a first rib and a second rib perpendicular to the first rib, the first ribs of the two positioning portions are spacingly disposed in parallel with each other and between distal ends of the two magnetic poles, the second rib of each positioning portion extends from the corresponding first rib in a direction away from the first rib of the other positioning portion, the distal end of each of the magnetic poles is disposed between the first rib and the second rib of the corresponding positioning portion and the outer wall surface of the sleeve, the first rib of each positioning portion limits movement of the corresponding magnetic pole toward the first rib, and the second rib of each positioning portion limits a radial movement of the corresponding magnetic pole away from the rotor.

* * * * *